US005549227A

United States Patent [19]

Klotz

[11] Patent Number: 5,549,227

[45] Date of Patent: Aug. 27, 1996

[54] BIDIRECTIONAL DISPENSER

[76] Inventor: James Klotz, 23730 Saravilla Dr., Mt. Clemens, Mich. 48043

[21] Appl. No.: 304,387

[22] Filed: Sep. 12, 1994

Related U.S. Application Data

[63] Continuation-in-part of Ser. No. 934,012, Aug. 21, 1992, abandoned.

[51] Int. Cl.[6] ..... B65D 1/02; B65D 25/40; B65B 39/00; B67C 11/00

[52] U.S. Cl. ..... 22/461; 222/462; 222/568; 222/570; 141/331; 43/54.1

[58] Field of Search ..... 222/460–462, 222/566–568, 570, 543; 141/331, 339–343; 43/54.1, 55, 56

[56] References Cited

U.S. PATENT DOCUMENTS

| | | | |
|---|---|---|---|
| 290,206 | 12/1883 | Brown | 141/343 |
| 573,333 | 12/1896 | Krimmel | 141/339 |
| 690,576 | 1/1902 | Hesse | 141/340 X |
| 777,670 | 12/1904 | Frazer | 141/343 |
| 3,203,134 | 8/1965 | Alden | 43/56 X |
| 3,211,195 | 10/1965 | Porter | 141/331 |
| 3,235,147 | 2/1966 | Hamilton | 222/543 |
| 3,401,696 | 9/1968 | O'Brien | 141/331 X |
| 3,879,879 | 4/1975 | Bobo . | |
| 3,949,510 | 4/1976 | Johnson . | |
| 4,002,275 | 1/1977 | Crowle et al. | 222/543 |
| 4,017,002 | 4/1977 | Doyle et al. . | |
| 4,060,923 | 12/1977 | Schmitz . | |
| 4,112,984 | 9/1978 | Guglia et al. | 141/339 X |
| 4,118,807 | 10/1978 | McCauley . | |
| 4,158,267 | 6/1979 | Farnsworth | 43/55 |
| 4,217,940 | 8/1980 | Wheeler | 222/568 X |
| 4,337,876 | 7/1982 | Thompson . | |
| 4,603,503 | 8/1986 | Haney | 43/56 |
| 4,703,867 | 11/1987 | Schoenhard | 141/331 X |
| 5,228,488 | 7/1993 | Fletcher | 141/331 |

FOREIGN PATENT DOCUMENTS

| | | | |
|---|---|---|---|
| 511512 | 4/1955 | Canada | 222/567 |
| 945561 | 5/1949 | France | 141/340 |
| 204746 | 10/1923 | United Kingdom | 141/340 |

OTHER PUBLICATIONS

Publication from Bass Pro Shops, date unknown.

*Primary Examiner*—Andres Kashnikow
*Assistant Examiner*—Lesley D. Morris
*Attorney, Agent, or Firm*—Bliss McGlynn, P.C.

[57] ABSTRACT

A dispenser member is adapted for connection to a bottle and includes a funnel, a structure for connecting the funnel to the bottle and a lid for opening and closing the funnel for loading and unloading objects from the bottle.

24 Claims, 8 Drawing Sheets

10
11
12
30
32
34
60
62
64
70
72
74

FIG 5
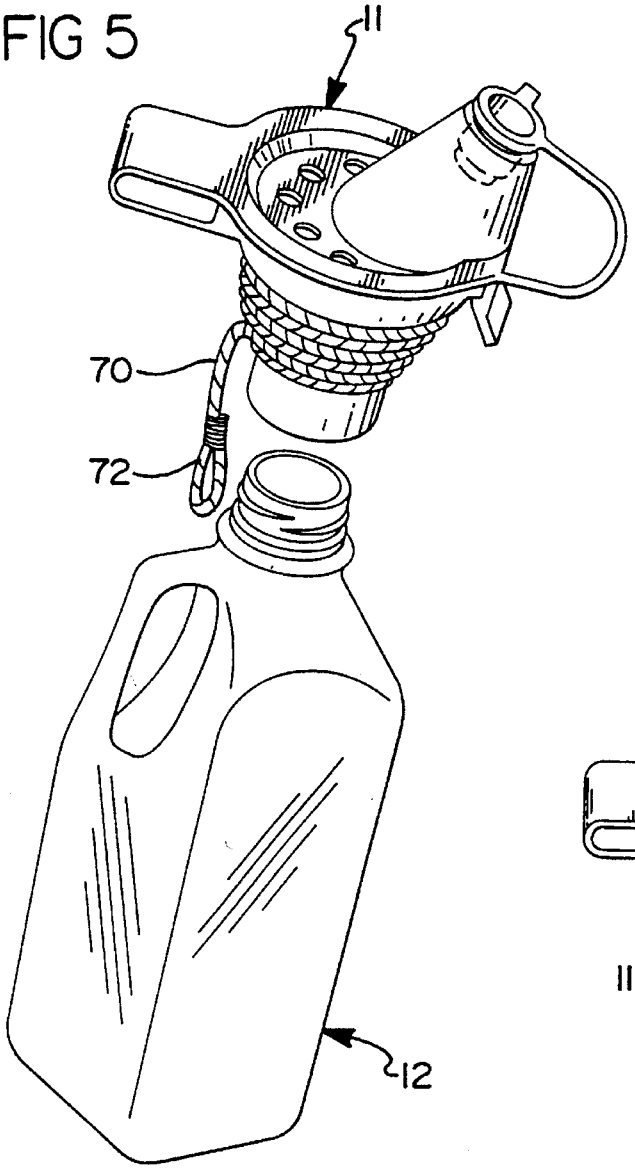
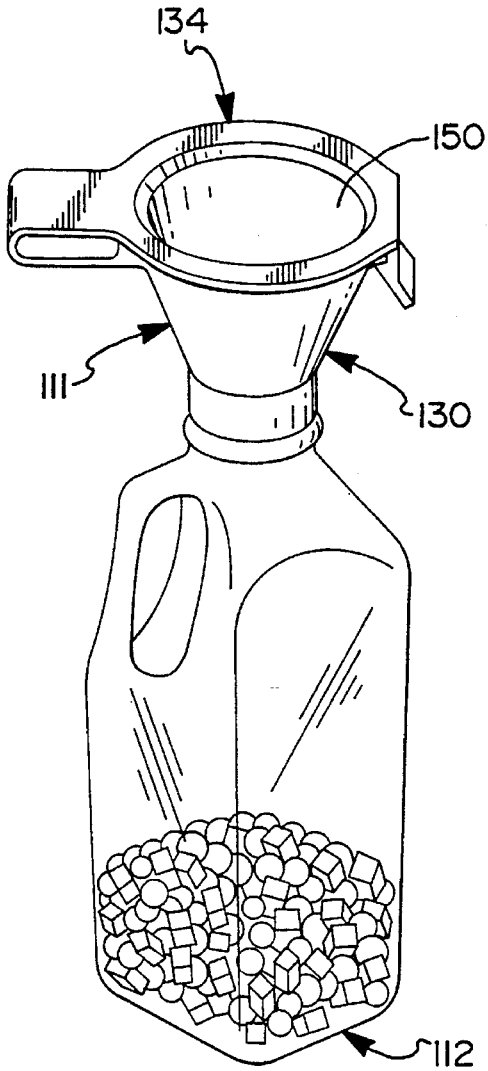
FIG 6

FIG 14
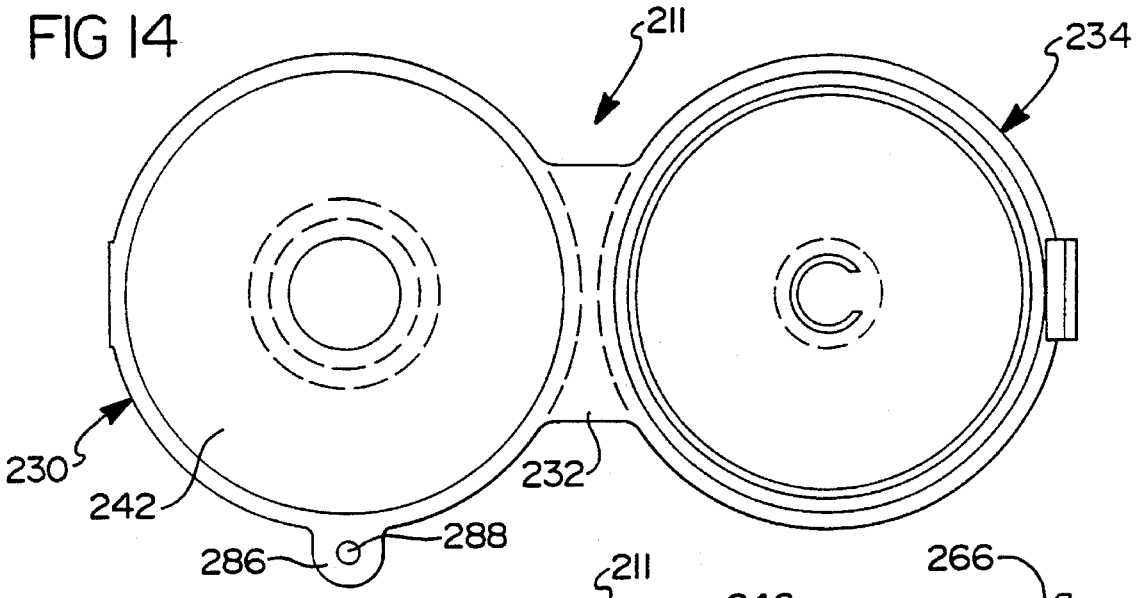
FIG 15
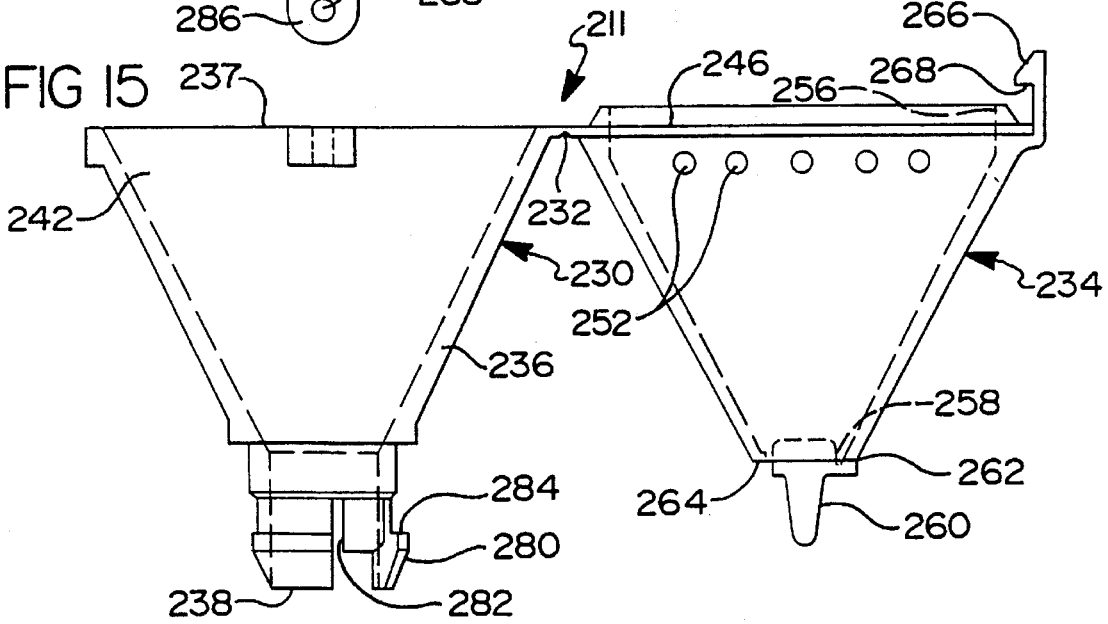
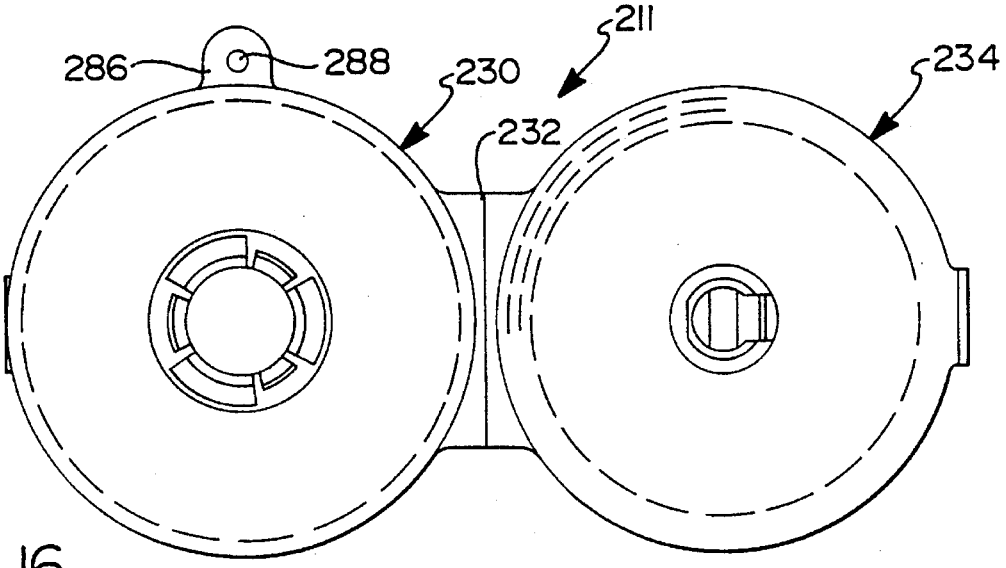
FIG 16

BIDIRECTIONAL DISPENSER

CROSS-REFERENCE TO RELATED APPLICATIONS

This application is a continuation-in-part of U.S. application Ser. No. 07/934,012, filed Aug. 21, 1992, now abandoned.

BACKGROUND OF THE INVENTION

1. Field of the Invention

The present invention relates generally to dispensers, and more particularly to, a bidirectional dispenser for filling and dispensing objects.

2. Description of Related Art

Generally, objects such as bait for fishing are held in a container such as a bait bucket. An example of such a bait bucket is disclosed in U.S. Pat. No. 4,606,143 to Murphy. The bait bucket includes a rigid container having a bait-removing opening therein. The bait bucket also includes a flexible substantially non-resilient bait-receiving member to allow live bait through the opening and into the bait-receiving member. The bait receiving member may then be opened and the bait removed.

One disadvantage of the above-patented bait bucket is that a special bucket is used. Another disadvantage is that the bucket may not float. Yet another disadvantage is that the bucket is not used to store food. Still another disadvantage is that a net or your hand must be used. A further disadvantage is that the bucket doesn't have a handle for easy pouring. Yet a further disadvantage is that the water can splash out of the wide opening of the bucket. A still further disadvantage is that a bait bucket cannot be stored in a tackle box.

SUMMARY OF THE INVENTION

It is, therefore, one object of the present invention to provide a bidirectional dispenser for objects.

It is another object of the present invention to provide a bidirectional dispenser that allows easy loading, retention, and removal of objects.

It is yet another object of the present invention to provide a floatable bidirectional dispenser.

It is still another object of the present invention to provide a bidirectional dispenser that incorporates a plastic bottle to form a lightweight storage container.

It is a further object of the present invention to provide a bidirectional dispenser that preserves the ecology by incorporating recycled plastic bottles.

It is also a further object of the present invention to provide a bidirectional dispenser member that can be assembled with a plastic bottle to accept, store, cook and serve granular food such as coffee, sugar, salt, flour, peas, corn kernels, diced carrots and other such vegetables.

It is yet a further object of the present invention to provide a bidirectional dispenser member that can be assembled with a plastic bottle to accept bait such as minnows, grasshoppers, crickets, and shrimp (for saltwater fishing) to form a light weight minnow bucket.

It is still a further object of the present invention to provide a bidirectional dispenser having a funnel adapted for connection to a bottle, providing simplified connection by a single movement.

It is a more further object of the present invention to provide a bidirectional dispenser to store liquids such as oil, chemicals, etc.

It is another object of the present invention to provide a bidirectional dispenser member having a lid including a dispensing opening and a permanently attached, yet easily removable, plug for the dispensing opening of the lid.

It is yet another object of the present invention to provide a bidirectional dispenser member having a funnel and a lid for loading and unloading objects from a bottle with a mechanism to orient the dispenser member with the handle of the bottle, to rotate the bottle when disposed in water, locate a tether position relative to the handle and locate vent holes for the dispenser member.

To achieve the forgoing objects, the present invention is a bidirectional dispenser member adapted for connection to a bottle including a funnel adapted for connection to the bottle. The bidirectional dispenser member also includes a lid for opening and closing the funnel for loading and unloading objects from the bottle.

Further, the present invention provides the funnel with a neck having a resiliently deflectable finger portion which may be deflected to allow the neck to interlockingly fit within the bottle opening. The present invention also provides a lid that is permanently hinged to the funnel and a selectively removable plug associated with a dispensing opening of the lid. The present invention may also provide an orientation mechanism which aligns the funnel with the handle of the bottle, rotates the bottle while in the water, locates the position of the tether relative to the handle of the bottle, and locates vent holes in the dispenser member relative to the bottle.

One advantage of the present invention is that the bidirectional dispenser incorporates a plastic bottle for accepting, holding, carrying and retrieving live bait, such as minnows, flies, shrimp or crickets; it is especially well suited for both fresh and saltwater fishermen. Another advantage of the present invention is that a stringer/tether is provided to enable the light weight dispenser to be carried or tethered in water and to string caught fish. Yet another advantage of the present invention is that a bidirectional dispenser member provides a funnel for easy loading of bait into the plastic bottle, a latchable lid to secure the bait and a spout on the lid to retrieve the bait. Still another advantage of the present invention is that tether can be coiled around the funnel, thereby forming a compact unit small enough to store in fishing or tackle box. A further advantage of the present invention is that the bidirectional dispenser can be molded by a two piece die. A still further advantage of the present invention is that the bidirectional dispenser is adapted for storage, cooking and serving of granular foods, especially small vegetables.

Yet another advantage of the present invention is that it facilitates the manner of connecting the funnel of the bidirectional dispenser to the bottle, by providing a connection adapted for connecting the aforesaid elements via a single, unidirectional movement. Another advantage of the present invention is that it provides a plug for the dispensing opening of the lid which is conveniently and permanently hinged to eliminate possible loss of the plug. Still another advantage of the present invention is that it provides a mechanism to orient the funnel such that the lid is located away from the bottle handle being held by the user, to rotate the dispenser member and bottle while in the water by the tether, to locate the position of the tether relative to the handle of the bottle to allow the bottle a correct exit attitude from the water, and to locate the vent holes in the dispenser member at the top thereof so that water does not exit through these holes when bait is dispensed. A further advantage of the present invention is that the bidirectional dispenser may be translucent such that the bait can be visualized as it travels to the dispensing opening.

Other objects, features and advantages of the present invention will be readily appreciated as the same becomes better understood after reading the subsequent description, taken in conjunction with the accompanying drawings.

BRIEF DESCRIPTION OF THE DRAWINGS

FIG. 5 is an exploded perspective view of the bidirectional dispenser of FIG. 1 and illustrating the tether secured to the exterior surface of a dispenser member.

FIG. 6 is a perspective view of another embodiment of the bidirectional dispenser of FIG. 1 and illustrating the dispenser loaded with granular objects.

FIG. 14 is a top view of the dispenser member of FIG. 10.

FIG. 15 is a side view of the dispenser member of FIG. 10.

FIG. 16 is a bottom view of the dispenser member of FIG. 10.

DESCRIPTION OF THE PREFERRED EMBODIMENT(S)

Figures 1, 2:
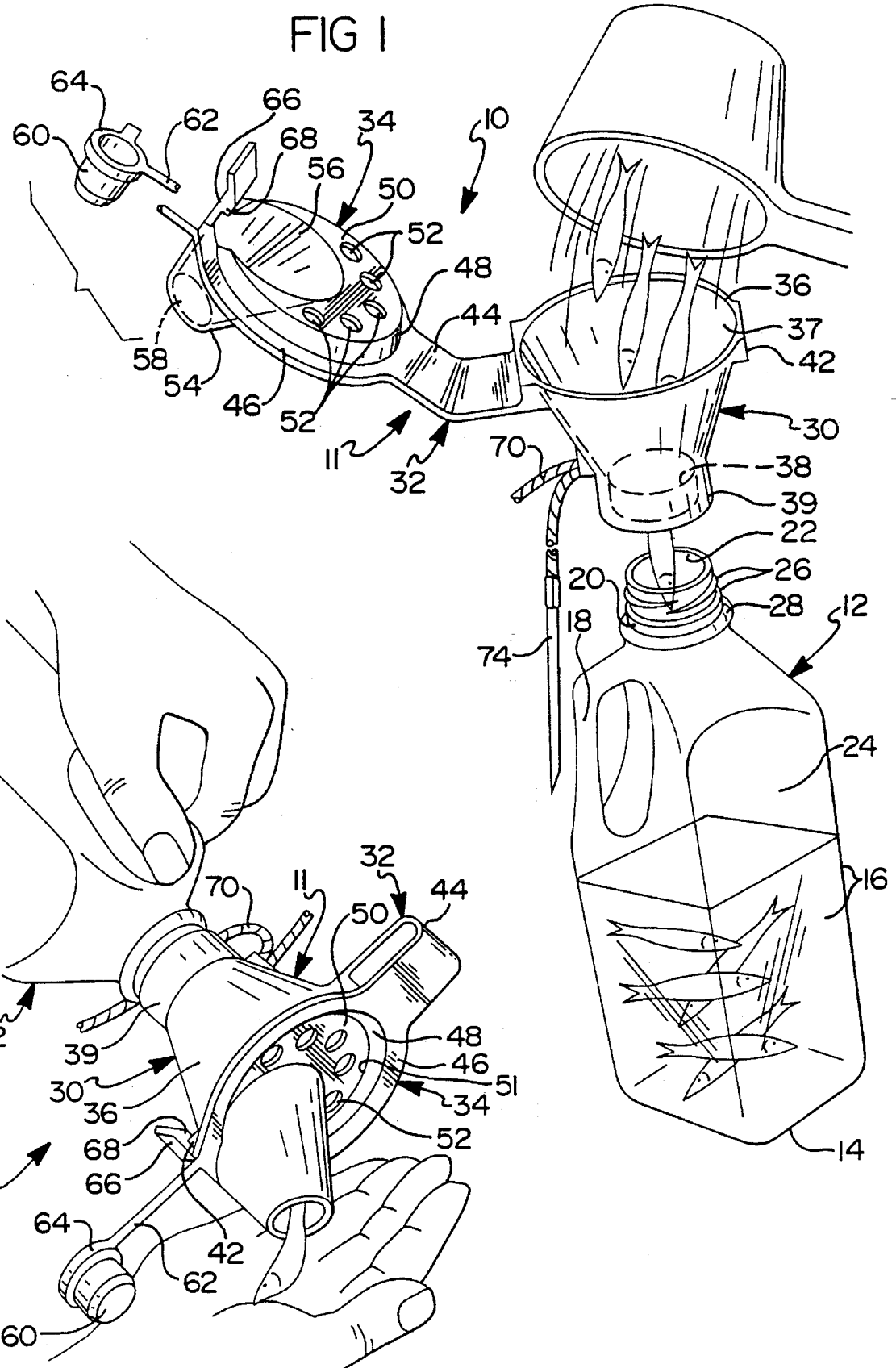
FIG. 1 is an exploded perspective view of a bidirectional dispenser according to the present invention and illustrating objects poured into the dispenser.
FIG. 2 is a perspective view of the bidirectional dispenser of FIG. 1 and illustrating objects retrieved from the dispenser.

Referring to FIGS. 1 and 2, a bidirectional dispenser 10, according to the present invention, is generally shown for dispensing objects such as bait for fishing. The bidirectional dispenser 10 includes a bidirectional dispenser member, generally indicated at 11, in operational relationship with a bottle, generally indicated at 12. The bottle 12 is commonly referred to as a plastic bottle which is conventional and well known. The bottle 12 may be transparent or translucent for viewing objects therein. The bottle 12 includes a bottom end 14 and side walls 16 to form a generally rectangular shape. The bottle 12 includes a handle 18 and a top end 20 forming an opening 22 which communicates with a hollow interior 24. The top end 20 is generally circular in shape and includes a plurality of threads 26 on an exterior surface thereof. The top end 20 also includes a shoulder 28 extending outwardly to act as a stop for a cap (not shown) which engages the threads 26 and removeably closes the opening 22. It should be appreciated that the bottle 12 is chosen as a discardable plastic milk bottle, juice bottle or the like. It should also be appreciated that the bottle 12 may be a custom translucent color blow molded bottle.

Referring to FIGS. 1 through 4, 7 and 8, the bidirectional dispenser member 11 includes a funnel, generally indicated at 30, a hinge, generally indicated at 32, and a lid, generally indicated at 34. The funnel 30 has a side wall 36 which is generally frusto-conical in shape to form a large diameter opening 37 at one end and a small diameter opening 38 at the other end. The funnel 30 has a neck 39 at the small diameter end 38 of the side wall 36. The neck 39 has a plurality of threads 40 on its interior surface which mate with the threads 26 on the bottle 12 to allow the dispenser member 11 to be screwed onto the bottle 12. The funnel 30 includes a retainer flange 42 extending radially outwardly from the side wall 36 at the large diameter opening 37 for a function to be described.

The hinge 32 is a generally rectangular strip 44 interconnecting the funnel 30 and the lid 34. The strip 44 is made of a plastic material and of a thickness to allow for flexing to act as a living hinge. It should be appreciated that the hinge 32 allows the lid 34 to be opened and closed relative to the funnel 30 such that the lid 34 is not separated or lost from the dispenser member 11. It should also be appreciated that hinge 32 can be of any suitable form to interconnect the funnel 30 and lid 34.

The lid 34 has a generally planar and circular base wall 46. The base wall 46 is connected to one end of the strip 44 which, in turn, has its other end connected to the side wall 36 of the funnel 30. The lid 34 includes a side wall 48 and a bottom wall 50 forming a cavity 51. The bottom wall 50 includes a plurality of apertures 52 extending therethrough to allow fluid such as air and/or water to enter and exit via the lid 34. The lid 34 also includes a spout 54 extending outwardly from the base, side and bottom walls 46, 48 and 50. The spout 54 has a generally frusto-conical shape with a large elliptical shaped opening 56 at one end and a small circular shaped opening 58 at the other end. The lid 34 includes a stopper plug 60 attached by a hinge member 62 to the base wall 46. The plug 60 is generally cylindrical in shape and includes a head portion 64 extending radially outwardly at one end. It should be appreciated that the plug 60 may be disposed in the opening 58 to close the spout 54.

The lid 34 further includes a latch member 66 for removeably securing the lid 34 to the funnel 30. The latch member 66 extends generally perpendicular from the base wall 46 and has a projection 68 extending radially y to engage and disengage the retainer flange 42 of the funnel 30. It should be appreciated that the latch member 66 flexes inwardly and outwardly. It should also be appreciated that the latch member can be of any suitable form to latch or removeably secure the lid 34 to the funnel 30.

The dispenser member 11 may include a tether 70 attached to the funnel 30. Preferably, the tether 70 is a cable, rope or the like having a loop or ring 72 at one end and a rigid spear 74 at the other end. The tether 70 is preferably molded or formed into the funnel 30 at a portion therealong or can extend through an aperture or hole (not shown) in funnel 30.

Figure 9A:
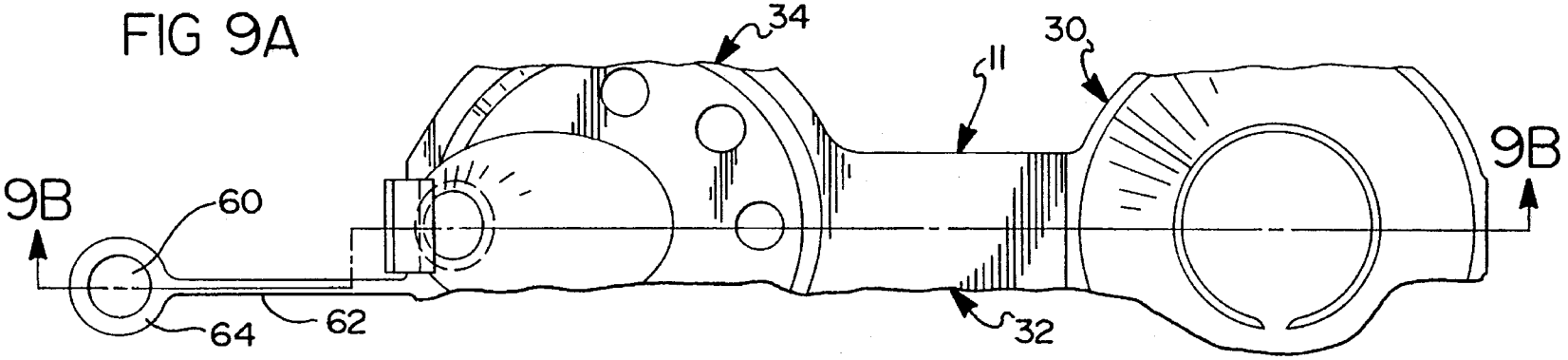
FIG. 9 is a sectional view of a die for making the dispenser member of FIG. 1.
Figure 9B:
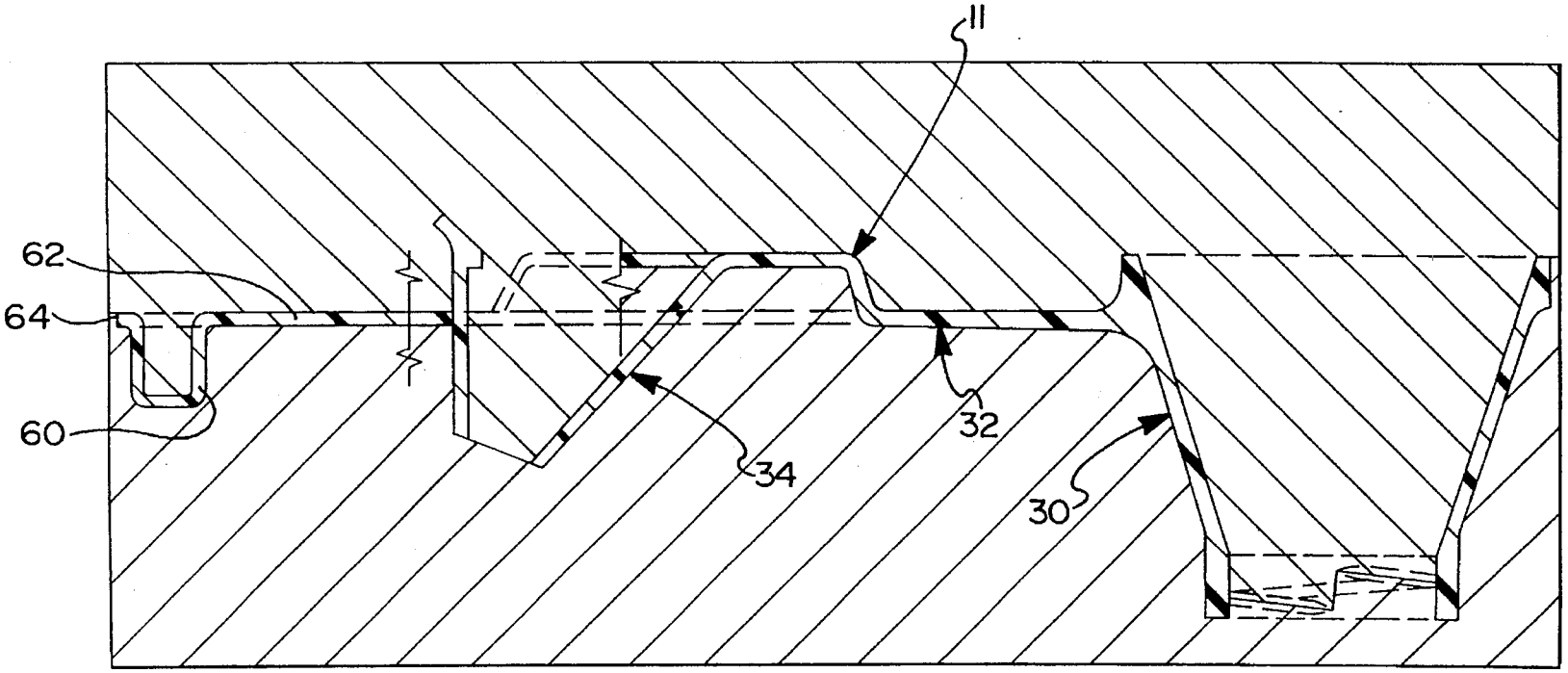

Referring to FIG. 9, a mold is shown for forming or molding the dispenser member 11. The mold is preferably used for injection molding of the dispenser member 11 in an injection molding machine as is commonly known in the art. It should be appreciated that dispenser member 11 can be molded in a two piece die.

In operation, once the dispenser member 11 has been molded, it is removed from the mold. The funnel 30 of the dispenser member 11 is threadably engaged with threads 26 of the bottle 14. With the lid 34 opened, objects such as fishing bait are loaded through the large diameter opening 37 of the funnel 30 and passed through the small diameter opening 38 to the hollow interior 24 of the bottle 12. As illustrated in FIG. 1, fishing bait such as minnows or shrimp and water are poured from a ladle into the large diameter opening 37 and pass through the small diameter opening 38 and opening 22 of the bottle 14 and fill the hollow interior 24. Once this has been accomplished, the lid 34 is rotated by the hinge 32 such that the latch member 66 is flexed to engage the projection 68 with the flange 42. With the lid 34 closed on the funnel 30, the bidirectional dispenser 10 may be tipped or rotated by the handle 18 as illustrated in FIG. 2. The plug 60 is then removed from the small diameter opening 58 of the spout 54. Preferably, one minnow exits the spout 54 and into the operator's hand to remove a single bait or object from the bidirectional dispenser 10. Once this has been accomplished, the plug 60 is reinserted or disposed in the small diameter opening 58 of the spout 54 to close the spout 54.

Figures 3, 4:
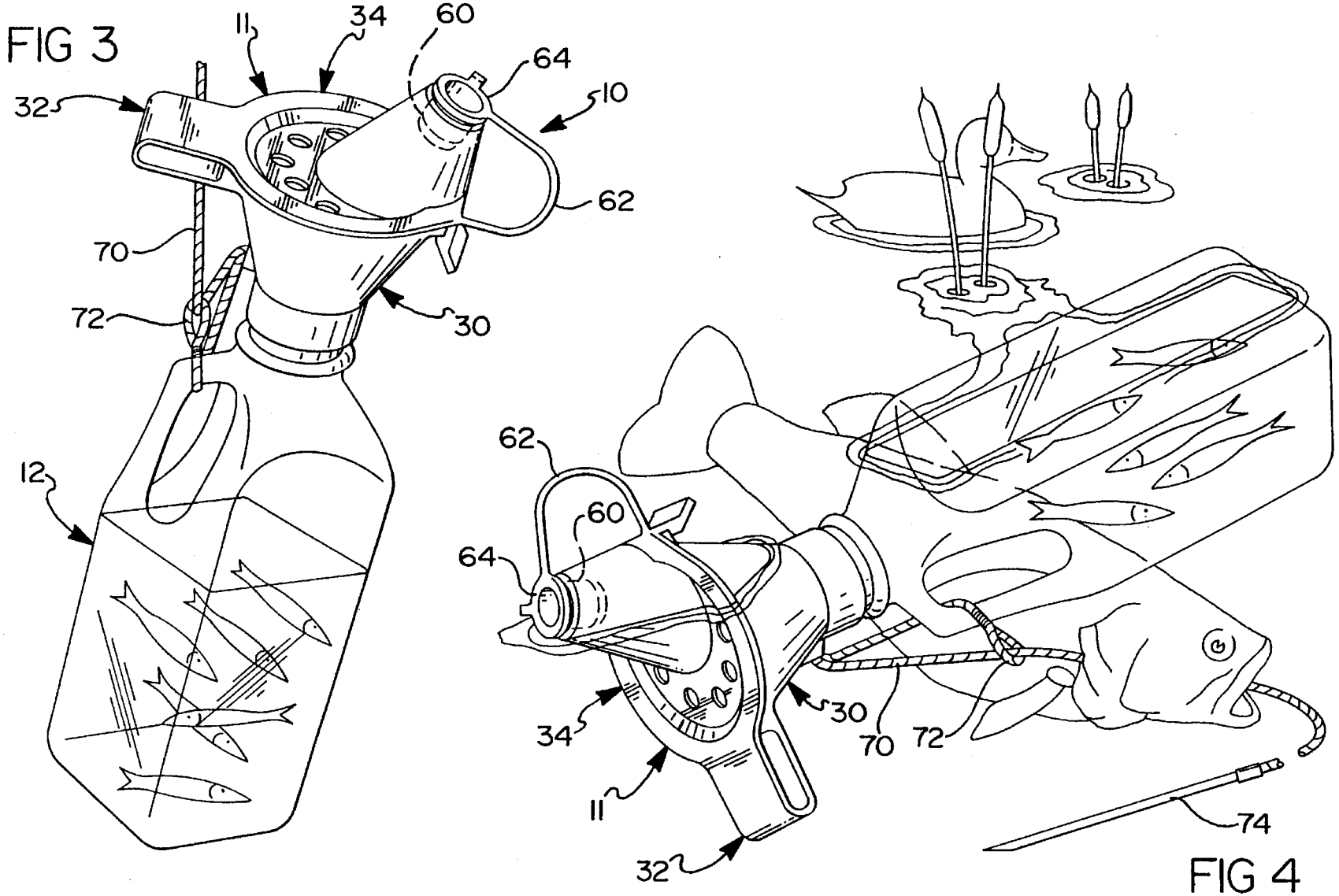
FIG. 3 is a perspective view of the bidirectional dispenser of FIG. 1 loaded with objects and suspended by a tether.
FIG. 4 is a perspective view of the bidirectional dispenser of FIG. 1 loaded with objects and illustrating the dispenser floating in water with the tether affixed through a caught fish.
Figure 7:
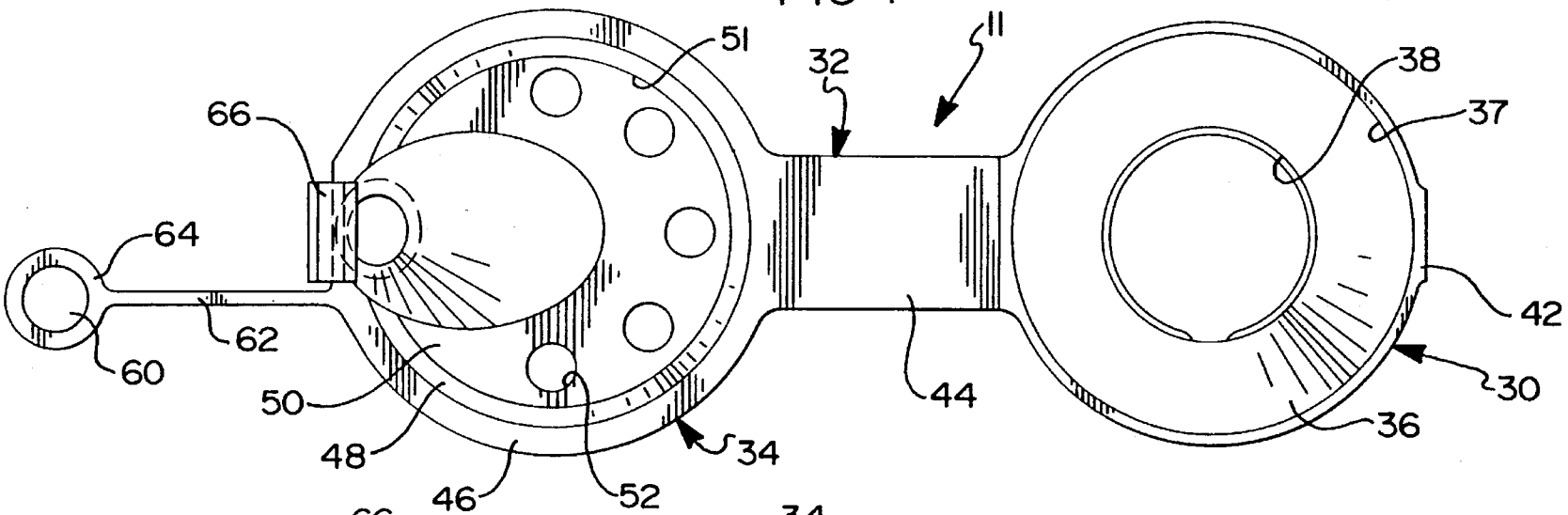
FIG. 7 is a top view of the dispenser member of FIG. 1.
Figure 8:
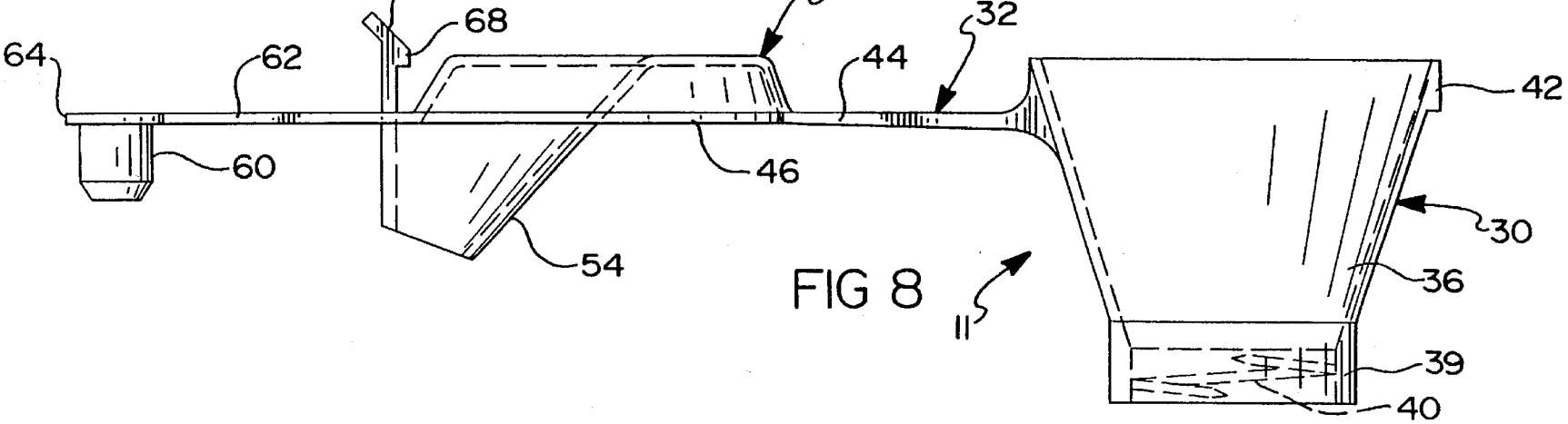
FIG. 8 is a side view of the dispenser member of FIG. 1.

As illustrated in FIG. 3, the tether 70 is passed through an opening between the handle 18 and the side wall 16. The spear 74 of the tether 70 is passed through the loop 72. The tether 70 may then be tied to an object such as a boat and the bottle 12 allowed to float in the water as illustrated in FIG. 4 to circulate water through the bidirectional dispenser 10 to keep the bait fresh. Further, the spear 74 of the tether 70 may be passed through a fish such that the bidirectional dispenser 10 has a dual purpose for storing fishing bait and caught fish. As illustrated in FIG. 5, the tether 70 may be wound around the outer surface of the side wall 36 of the funnel 30. This allows the tether 70 to be secured to the outer surface of the dispenser member 11 to form a compact unit which can be easily stored in fishing or tackle box and not become tangled with other baits therein. Alternatively, the tether 70 may be coiled and enclosed inside the bidirectional dispenser member 11 to prevent tangling.

Referring to FIG. 6, an alternate embodiment of the bidirectional dispenser 10 is shown. Like parts of the bidirectional dispenser 10 have like reference numerals increased by one hundred (100). The bidirectional dispenser member 111 has a lid 134 which eliminates the spout and plug. Preferably, the bottom wall 150 is planar and eliminates any apertures. As a result, no fluid is allowed to enter and exit via the lid 134. The lid 134 may be opened and granular objects such as food may be poured through the funnel 130 and stored in the bottle 112. As illustrated, the objects are granular food such as peas, carrots, etc. The lid 134 is closed on the funnel 130 to provide a sealed air-tight container.

Figure 10:
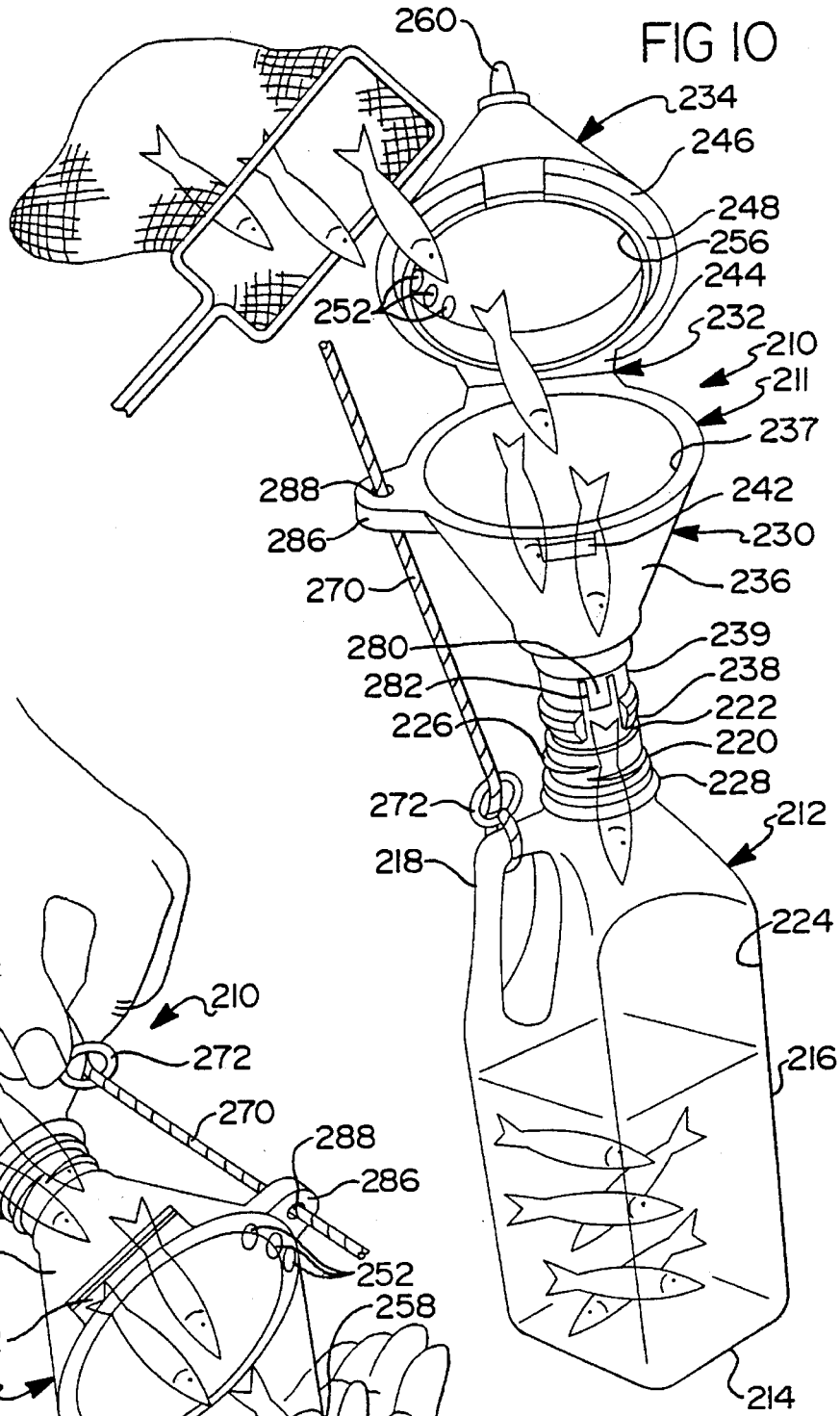
FIG. 10 is an exploded perspective view of another bidirectional dispenser according to the present invention and illustrating objects poured into the dispenser.
Figure 11:
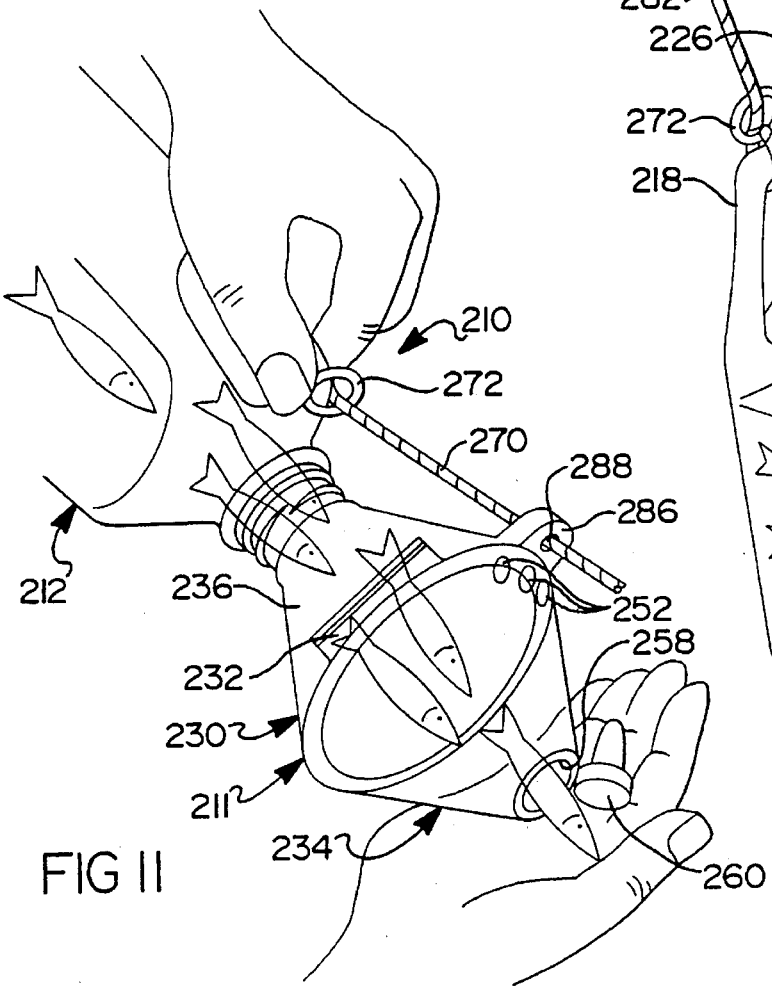
FIG. 11 is a perspective view of the bidirectional dispenser of FIG. 10 and illustrating objects dispensed and retrieved from the dispenser.

Referring to FIGS. 10 and 11, a bidirectional dispenser 210, according to the present invention, is generally shown for dispensing objects such as bait for fishing. Elements of the bidirectional dispenser 210 which are analogous to elements of the bidirectional dispenser 10 are given like reference numerals increased by two hundred (200). The bidirectional dispenser 210 includes a bidirectional dispenser member, generally indicated at 211, in operational relationship with a bottle, generally indicated at 212. The bottle 212 is commonly referred to as a plastic bottle which is conventional and well known. The dispenser member 211 and/or bottle 212 may be transparent or translucent color for viewing the objects therein. The bottle 212 includes a bottom end 214 and side walls 216 to form a generally rectangular shape. The bottle 212 includes a handle 218 and a top end 220 forming an opening 222 which communicates with a hollow interior 224. The top end 220 is generally circular in shape and includes a plurality of threads 226 on an exterior surface thereof. The top end 220 also includes a shoulder 228 extending outwardly to act as a stop for a cap (not shown) which engages the threads 226 and removeably closes the opening 222. It should be appreciated that the bottle 212 is chosen as a discardable plastic milk bottle, juice bottle or the like. It should also be appreciated that the bottle 12 may be a custom translucent color blow molded bottle.

Referring to FIGS. 10 through 16, the bidirectional dispenser member 211 includes a funnel, generally indicated at 230, a hinge, generally indicated at 232, and a lid, generally indicated at 234. The funnel 230 has a side wall 236 which is generally frusto-conical in shape to form a large diameter opening 237 at one end and a small diameter opening 238 at the other end. The funnel 230 has a neck 239 at the small diameter opening 238 of the side wall 236. In place of threads, the bidirectional dispenser member 211 provides the neck 239 with at least one resiliently deflectable finger portion 280 as illustrated in FIGS. 10 and 15. The finger portion 280 is disposed along the circumference of the generally circular neck 239 and is defined by slots 282 which separate the finger portion 280 from the remainder of neck 239. The finger portion 280 also has a retaining shoulder or lip 284 which assists the retention of the neck 239 into interlocking fit within the opening 222 of the bottle 212.

To provide a simplified, unidirectional single connecting movement to connect the funnel 230 to the bottle 212, the operator deflects the finger portion 280 radially inwardly to reduce the effective circumference of the neck 239. The operator then inserts the neck 239, while deflecting the finger portion 280 into the reduced circumference, into the opening 222 of the bottle 212, using a single, unidirectional movement. Once the neck 239 is inside the opening 222, the finger portion 280 is released, the resilient nature of the finger portion 280 urges the finger portion 280 back to its original position and returns the effective circumference of the neck 239 to its original size. This allows the retaining lip 284 to secure the neck 239 within the opening 222 of the bottle 212, achieving an interlocking fit therebetween. The funnel 230 also includes a retainer flange 242 extending radially outwardly from the side wall 236 at the large diameter opening 237 for a function to be described.

The hinge 232 extends along a substantial portion of the circumference of the large diameter opening 237 and is generally of relatively short length between the funnel 230 and the lid 234. The hinge 232 is preferably formed of a plastic material. The hinge 232 should be of a thickness to allow repeated flexing to act as a living hinge, keeping in mind that the extension of the hinge 232 along a substantial portion of the circumference of the large diameter opening 237 assists in ensuring a long useful life.

As illustrated in FIGS. 10 through 13, the lid 234 has a generally frusto-conical shape, forming a spout having a large diameter opening 256 at one end and a small diameter opening 258 at the other, discharging or dispensing end. The lid 234 includes a plurality of vent holes or apertures 252 extending through the lid 234 to allow fluids such as air or water or both to enter and exit the bidirectional dispenser 210 and bottle 212, via the lid 234 to circulate the water and keep bait fresh. The lid 234 includes a base wall 246 and a side wall 248 which fits within the side wall 236 of the funnel 230 to improve the seal between the funnel 230 and the lid 234 when these two components are closed.

The lid 234 also includes a stopper or plug 260 connected to the lid 234 by a living hinge 262 disposed at the small diameter opening 258 of the discharging end of the lid 234. The plug 260 is thus selectively removable from the small diameter opening 258 of the lid 234. Again, it should be appreciated that the living hinge 262 should be formed of a suitable plastic material having sufficient thickness to ensure a long useful life. It should also be appreciated that associating the plug 260 with the opening 258 via the living hinge 262 eliminates the possible loss of the plug 260 from the bidirectional dispenser 210.

As seen in FIG. 15, the lid 234 is also provided with a plug latch 264 for selectively latching and unlatching the plug 260 into and from the opening 258 of the lid 234. In one embodiment, the plug latch 264 may be in the form of a retaining tab disposed on the interior of the opening 258 suitable to retainingly engage an appropriately configured tab receiving portion disposed on the periphery of the plug 260, neither of which are shown. Alternatively, the plug latch 264 may be in the form of a flexible plug latching member extending from the plug 260 and a plug latching flange extending outwardly from lid 234, the plug latching member flexing to engage and disengage the plug latching flange, neither of which are shown, in a manner similar to that described in the bidirectional dispenser 10. It should also be appreciated that the plug latch 264 can also be of any other suitable form to latch and unlatch the plug 260 from the small diameter opening 258 of the spout 254.

The lid 234 further includes a latch member 266 for removeably securing the lid 234 to the funnel 230. The latch member 266 extends generally perpendicular from the base wall 246 and has a projection 268 extending radially inwardly to engage and disengage the retainer flange 242 of the funnel 230. It should be appreciated that the latch member 266 flexes inwardly and outwardly. It should also be appreciated that latch member 266 can be of any suitable form to latch or removeably secure the lid 234 to the funnel 230.

The dispenser member 211 may include a tether 270 attached to the funnel 230. Preferably, the tether 270 is a cable, rope or the like having a loop or ring 272 at one end and a rigid spear 274 at the other end. While the tether 270 may be molded or formed into the funnel 230 at a portion therealong, in the present embodiment, it extends through an aperture or hole 288 in an orientation tab 286 disposed upon the periphery of the large diameter opening 237 of the funnel 230. It should be appreciated that the orientation tab 286 locates the position of the tether 270 on the handle 218 of the bottle 212 to provide a proper exit attitude of the bidirectional dispenser 210 from the water.

As described above, the orientation tab 286 is disposed along the periphery of large diameter opening 237 some spaced distance away from hinge 234 such that when the orientation tab 286 is aligned with the handle 218 of the bottle 212, the hinge 232 opens so that the lid 234 opens away from the handle 218. As a result, when the dispenser member 211 is open for loading objects into the bottle 212 through the funnel 230, the lid 234 opens away from the handle 218, typically being held by the operator. Thus, the orientation tab 286 may be located along the circumference of the opening 237 at an angle of approximately 90° from the hinge 232, although it will be appreciated that other angular positionings of the orientation tab 286 and hinge 232 along the circumference of the opening 237 also are suitable for the purpose discussed above. It should be appreciated that the orientation tab 286 locates the apertures 252 at the top of the lid 234 so that water does not exit through these holes when bait is dispensed.

In operation, once the dispenser member 211 has been molded, it is removed from the mold. The funnel 230 of the dispenser member 211 is engaged with the bottle 212 by deflecting the finger portion 280 to decrease the effective circumference of the neck 239, engaging the neck 239 while deflecting the finger portion 280 into the opening 222 of the bottle 212 with a single, unidirectional movement, and subsequently releasing the finger portion 280 so that it resiliently returns to its original position thus increasing the effective circumference of the neck 239 and achieving an interlocking fit between the neck 239 and opening 222. With the lid 234 opened, objects such as fishing bait are loaded through the large diameter opening 237 of the funnel 230 and passed through the small diameter opening 238 to the hollow interior 224 of the bottle 212. As illustrated in FIG. 10, fishing bait such as minnows or shrimp and water are poured from a net into the large diameter opening 237 and pass through the small diameter opening 238 and opening 222 of the bottle 212 and fill the hollow interior 224. Once this has been accomplished, the lid 234 is rotated by the hinge 232 such that the latch member 266 is flexed to engage the projection 268 with the flange 242. With the lid 234 closed on the funnel 230, the bidirectional dispenser 210 may be tipped or rotated by the handle 218 as illustrated in FIG. 11. The plug 260 is then removed from the small diameter opening 258 of the lid 234. The translucent bidirectional dispenser 210 allows the operator to view the bait as it travels to the small diameter opening 258. Preferably, one minnow exits the lid 234 and into the operator's hand to remove a single bait or object from the bidirectional dispenser 210. Once this has been accomplished, the plug 260 is reinserted or disposed in the small diameter opening 258 of the lid 234 to close the opening 258.

Figures 12, 13:
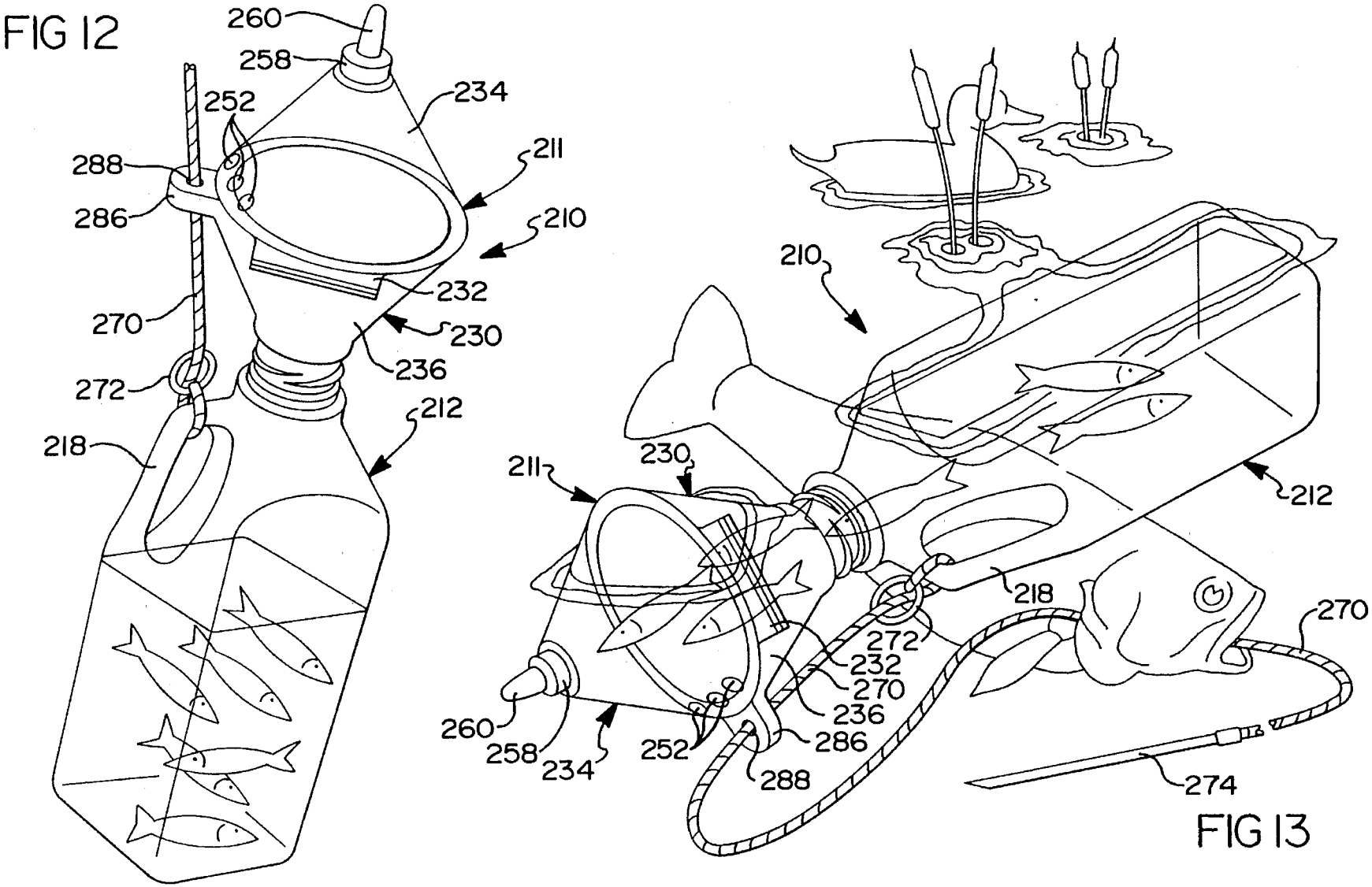
FIG. 12 is a perspective view of the bidirectional dispenser of FIG. 10 loaded with objects and suspended by a tether.
FIG. 13 is a perspective view of the bidirectional dispenser of FIG. 10 loaded with objects and illustrating the dispenser floating in water with the tether affixed through a caught fish.

As illustrated in FIG. 13, the tether 270 is passed through an opening between the handle 218 and the side wall 216 of the bottle 212. The spear 274 of the tether 270 is passed through the loop or ring 272. The tether 270 may then be tied to an object such as a boat and the bidirectional dispenser 210 allowed to float in the water as illustrated in FIG. 13 to circulate water through the bidirectional dispenser 210 and keep the bait fresh. Further, the spear 274 of the tether 270 may be passed through a fish such that the bidirectional dispenser 210 has a dual purpose for storing fishing bait and caught fish. The tether 270 may be wound around the outer surface of the side wall 236 of the funnel 230 or disposed inside the dispenser member 211 to form a compact unit which can be easily stored in fishing or tackle box and not become tangled with other baits therein.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A bidirectional dispenser member adapted for connection to a bottle, comprising:

a funnel adapted for connection to a bottle; and a lid connected to said funnel for opening and closing said funnel for loading and unloading objects from the bottle, said lid including an inverted funnel-shaped spout to dispense objects from the bottle one at a time when said lid is closed on said funnel.

2. A bidirectional dispenser member as set forth in claim 1 wherein said funnel has a large diameter opening at one end and a small diameter opening at the other end and said lid being connected to said funnel.

3. A bidirectional dispenser member as set forth in claim 1 including a plug removably disposed in a opening of said spout and a hinge member interconnecting said plug and said lid.

4. A bidirectional dispenser member as set forth in claim 1 further comprising a tether attached to said funnel.

5. A bidirectional dispenser member as set forth in claim 1 wherein said funnel comprises a side wall forming a large diameter opening at one end and a small diameter opening at the other end, and a neck portion extending from said side wall at said small diameter opening.

6. A bidirectional dispenser member as set forth in claim 5 including means for connecting said neck portion to the bottle.

7. A bidirectional dispenser member as set forth in claim 5 including means on an interior of said neck portion for connecting said neck portion to the bottle.

8. A bidirectional dispenser member as set forth in claim 1 wherein said lid includes a base wall and a side wall extending axially from said base wall and into said funnel when said lid is closed on said funnel.

9. A bidirectional dispenser member adapted for connection to a bottle, comprising:

a funnel adapted for connection to a bottle;

a lid for opening and closing said funnel for loading and unloading objects from the bottle;

said lid including a spout having an opening at one end for allowing objects to be discharged from the bottle when said lid is closed on said funnel; and wherein said lid includes means forming a plurality of apertures around said spout.

10. A bidirectional dispenser member adapted for connection to a bottle, comprising:

a funnel adapted for connection to a bottle;

a lid for opening and closing said funnel for loading and unloading objects from the bottle;

a tether attached to said funnel; and wherein said tether has a spear at one end and a loop at the other end.

11. A bidirectional dispenser for dispensing bait comprising:

a container;

a funnel adapted for connection to said container; and a lid connected to said funnel for opening and closing said funnel for locking and unlocking bait from said container, said lid including an inverted funnel-shaped spout to dispense objects from said container one at a time when said lid is closed on said funnel.

12. A bidirectional dispenser for objects, comprising:

a bottle having a top end and a top end opening therein;

a funnel having a neck at one end;

at least one resiliently deflectable finger portion disposed along a circumference of said neck deflectable to size said neck to interlockingly fit within said top end opening; and a lid having a funnel-shape connected to said funnel for opening and closing said funnel for loading and unloading objects from said bottle.

13. A bidirectional dispenser as set forth in claim 12 wherein said lid includes an opening and a plug adapted to be disposed into and removed from said opening of said lid.

14. A bidirectional dispenser as set forth in claim 13 including a flexible plug latching member extending from said plug and a plug latching flange extending outwardly from said lid, said plug latching member flexing to engage and disengage said plug latching flange.

15. A bidirectional dispenser for objects, comprising:

a bottle having a top end and a top end opening therein;

a funnel having a neck at one end;

at least one resiliently deflectable finger portion disposed along a circumference of said neck deflectable to size said neck to interlockingly fit within said top end opening;

a lid for opening and closing said funnel for loading and unloading objects from said bottle; and wherein said lid includes means forming a plurality of apertures extending therethrough.

16. A bidirectional dispenser member adapted for connection to a bottle having a handle, comprising:

a funnel adapted for connection to a bottle, said funnel having an orientation tab allowing orientation of said funnel relative to the handle; and a lid for opening and closing said funnel for loading and unloading objects from the bottle.

17. A bidirectional dispenser member as set forth in claim 16 wherein said orientation tab includes a tether retaining aperture.

18. A bidirectional dispenser member as set forth in claim 16 wherein said lid is connected to said funnel by a living hinge disposed away from said orientation tab whereby the lid opens away from the handle to facilitate unobstructed loading of the bottle through said funnel.

19. A bidirectional dispenser for dispensing bait comprising:

a container;

a funnel connected to said container;

a lid having a funnel-shape connected to said funnel for opening and closing said funnel for loading and unloading bait from said container; and either one of said container and funnel and lid being translucent for view bait therethrough.

20. A bidirectional dispenser as set forth in claim 19 wherein said container is a custom translucent color blow molded bottle.

21. A bidirectional dispenser member adapted for connection to a bottle, comprising:

a funnel adapted for connection to a bottle; and a lid connected to said funnel for opening and closing said funnel for loading and unloading objects from the bottle, said lid having a base wall and a side wall extending axially from said base wall and into said funnel when said lid is closed on said funnel; and wherein said funnel comprises a side wall forming a large diameter opening at one end and a small diameter opening at the other end, and a neck portion extending from said side wall at said small diameter opening.

22. A bidirectional dispenser for objects, comprising:

a bottle;

a funnel;

means for connecting said funnel to said bottle;

a lid for opening and closing said funnel for loading and unloading objects from said bottle;

hinge means interconnecting said funnel and said lid;

said lid including spout means for allowing objects to be discharged from said bottle when said lid is closed on said funnel;

said spout means comprising a spout having a frusto-conical shape and an opening at one end;

said lid including means forming a plurality of apertures about said spout; and wherein said funnel comprises a side wall forming a large diameter opening at one end and a small diameter opening at the other end, and a neck portion extending from said side wall at said small diameter opening.

23. A bidirectional dispenser for objects comprising:

a container;

a funnel associated with said container;

a lid associated with said funnel and having an inverted funnel-shape for opening and closing said funnel for loading and unloading objects from said container.

24. A bidirectional dispenser for objects comprising:

a bottle having a top end associated with a funnel shaped form having a top end opening; and a lid associated with said funnel shaped form for opening and closing said top end opening of said funnel shaped form for loading and unloading objects from said bottle, said lid including a geometric dispersal opening for gathering objects and for expelling objects one at a time when said lid is closed on said funnel shaped form.

* * * * *